US005702085A

United States Patent [19]

Nissim et al.

[11] Patent Number: 5,702,085

[45] Date of Patent: Dec. 30, 1997

[54] SUPPORT FOR BALANCING SCULPTURE

[75] Inventors: Ofer Nissim, Pound Ridge, N.Y.; Marc Goldblatt, Stamford, Conn.

[73] Assignee: Ark Foundation, LLC, Norwalk, Conn.

[21] Appl. No.: 649,293

[22] Filed: May 17, 1996

[51] Int. Cl.[6] ..... A47G 1/16

[52] U.S. Cl. ..... 248/475.1; 248/307; 248/915; D8/367; D8/370; 119/468

[58] Field of Search ..... 248/475.1, 299.1, 248/304, 307, 489, 497, 207, 339, 915, 317, 322; 47/67; D6/556; 119/468, 531, 537, 51.03; D8/373, 367, 370

[56] References Cited

U.S. PATENT DOCUMENTS

| | | | |
|---|---|---|---|
| 311,246 | 1/1885 | Herrick et al. | 248/304 |
| 521,952 | 6/1894 | Faries | 248/299.1 X |
| 522,510 | 7/1894 | Church | 248/299.1 X |
| 542,860 | 7/1895 | Noxon | 248/299.1 X |
| 1,154,627 | 9/1915 | Hall | 47/67 H X |
| 3,820,195 | 6/1974 | Hutzell | 248/339 X |
| 3,854,242 | 12/1974 | Gladstein | 47/6 H X |
| 4,098,483 | 7/1978 | Pesola et al. | 248/304 X |
| 4,556,184 | 12/1985 | O'Sullivan | 47/67 H X |
| 5,553,823 | 9/1996 | Protz, Jr. | 248/339 X |

*Primary Examiner*—Ramon O. Ramirez
*Assistant Examiner*—Stephen S. Wentsler
*Attorney, Agent, or Firm*—Patrick J. Walsh

[57] ABSTRACT

A support for a balancing sculpture in the form of an arcuate perch with a hanger mounted on the perch for movement between a first position for suspending the support from a ceiling, and a second position for mounting the support on a wall with the hanger engaging a wall hook.

6 Claims, 3 Drawing Sheets

SUPPORT FOR BALANCING SCULPTURE

BACKGROUND OF THE INVENTION

The present invention relates to supports and particularly to a support for a balancing sculpture or similar work. The support can be affixed to a wall or suspended from a ceiling.

Copending U.S. patent application Ser. No. 599,549 filed Dec. 19, 1995, discloses a balancing sculpture that has a balancing point for replicating the natural posture or carriage of a replicated figure. Specifically the copending application discloses a jigsaw puzzle sculpture in the form of an exotic bird such as a parrot. The puzzle comprises a plurality of interlocking pieces and is provided with a suspension point relative to the sculpture's center of gravity. In a preferred embodiment of balancing sculpture disclosed in said copending application, the center of gravity is located below the suspension point. The suspension point coincides with a recess in the sculpture with the recess replicating a natural feature of the sculpture such as a parrots claws. By supporting the sculpture at the suspension point or parrots claws, the sculpture displays natural posture and movement.

The present invention provides a support for mounting balancing sculptures at their suspension point so that the sculpture may be displayed in natural posture or carriage.

SUMMARY OF THE INVENTION

The balancing support of the invention comprises an arcuate perch with a movable hanger. In preferred form the perch defines a major segment of a circle and the hanger is adjustable from first to second positions to provide suspension of the support from a ceiling or to provide mounting of the support on a wall.

OBJECTS OF THE INVENTION

An object of the invention is to provide a support for a balancing sculpture.

Another object of the invention is to provide a support for a balancing sculpture which can be suspended from a ceiling or mounted on a wall.

Another object of the invention is to provide a support for a balancing sculpture wherein the sculpture assumes a natural posture or stance.

Other and further objects of the invention will become apparent with an understanding of the following detailed description of the invention or upon employment of the invention in practice.

A preferred embodiment of the invention has been chosen for purposes of detailed description and is shown in the accompanying drawing in which.

DETAILED DESCRIPTION OF THE PREFERRED EMBODIMENT

Figure 1:
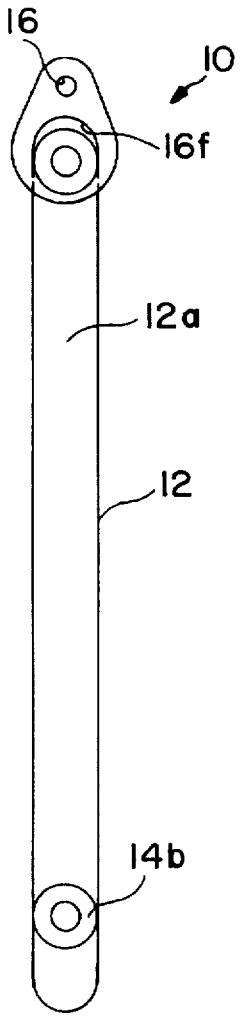
FIG. 1 is a front view of the support according to the invention.

Referring to the drawing, the support 10 comprises an arcuate perch 12 preferably defining an arc of a circle greater than 180 deg. and preferably about 210 degrees from tip A to tip B. The perch is formed of a tubular member with circular cross-section, and with finishing plugs **14*a*, 14*b*** fitted into each end of the tube at tips A and B.

Figure 2:
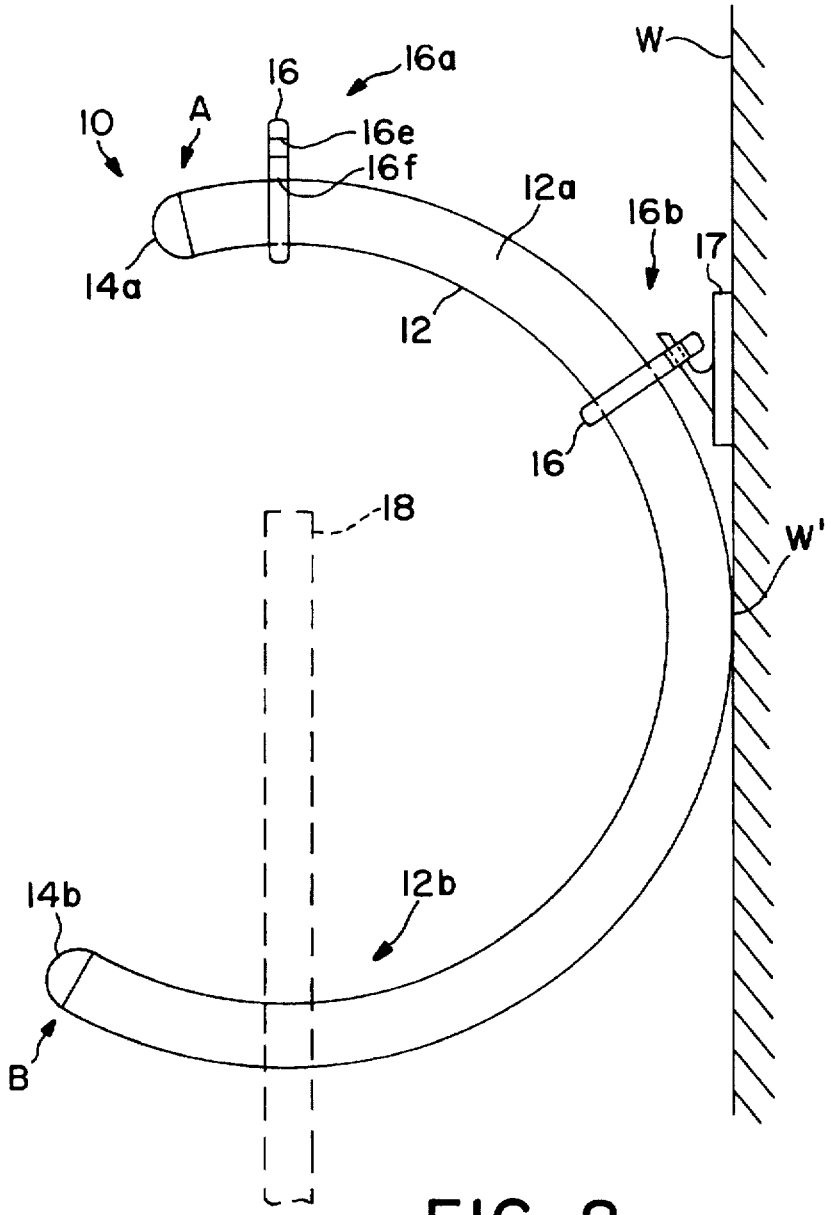
FIG. 2 is a side elevational view of the support of FIG. 1.

A hanger 16 is slidably mounted on the perch for suspending the perch from a ceiling or mounting the perch on a wall W. Both positions (**16*a* ceiling position, 16*b* wall position) are shown in FIG. 2** and it is to be understood that a single hanger is used in either one of the two positions shown.

The hanger 16 comprises a hub **16*c* and integral upstanding connector plate 16*d*. The plate includes an aperture 16*e* for connection to a support line suspended from a ceiling. The hub has a central bore 16*f* conforming to the outer contour 12*a*** of the perch for slidably fitting the hanger onto the perch.

In the first hanger position **16*a*, the support is connected to a ceiling line or wire (not shown) for suspending the support and displaying a balancing sculpture. In the second hanger position 16*b*, the support is mounted on a wall by connection of the upper aperture to a suitable wall fitting such as a wall hook 17**. The support is maintained in this position by the wall hook and by contact at W' between the perch and the wall below the wall hook.

Figure 5:
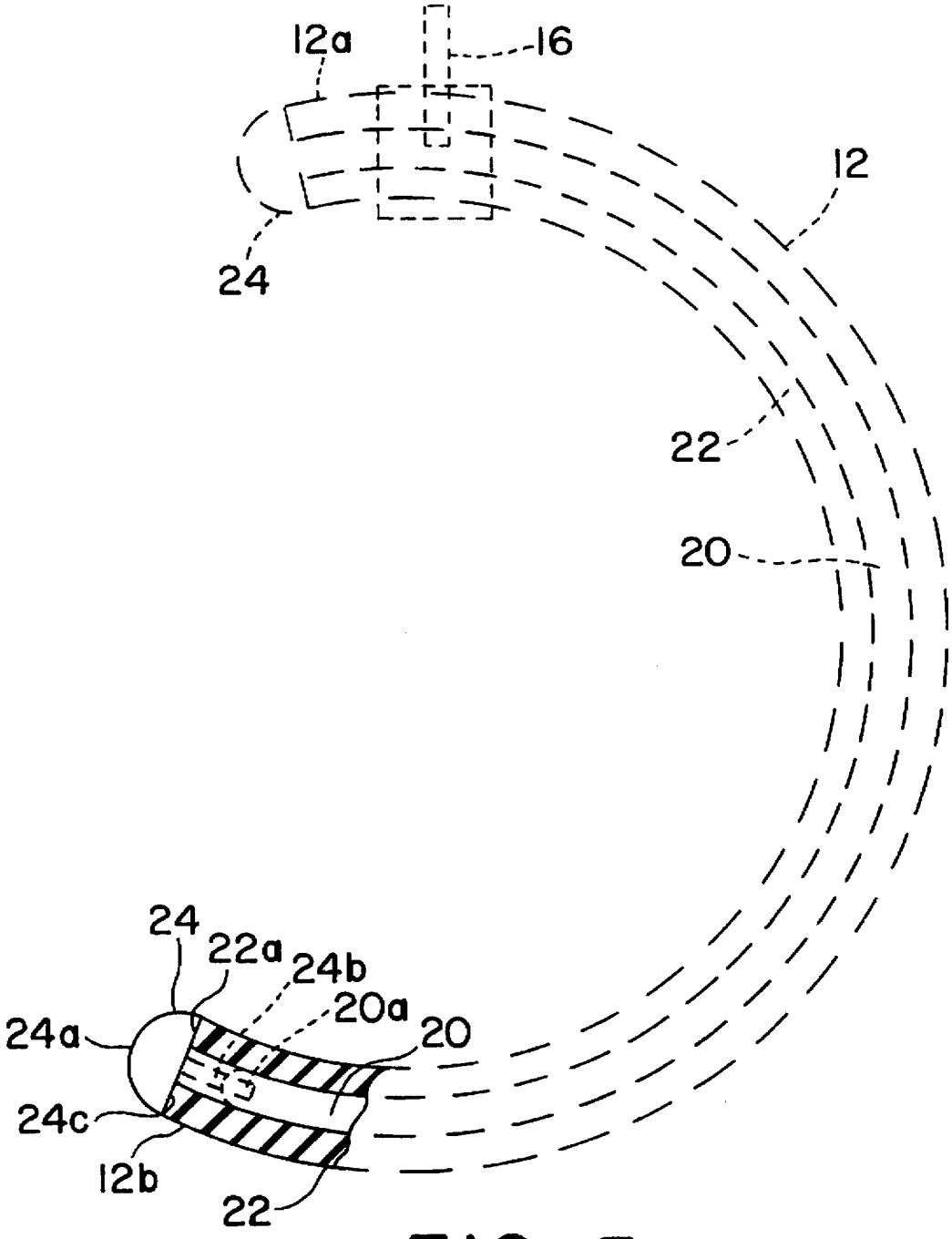
FIG. 5 is a side elevational view of a modified perch according to the invention.

A modified structure for the perch 12 is shown in FIG. 5 and comprises an assembly of a crescent shaped rod 20 preferably of steel defining a core for the perch, together with a covering tube 22 preferably formed of foam rubber and fitted onto the rod. End caps 24 each having a domed head **24*a* and axial connecting shaft 24*b* are applied to the tips 12 *a–b* of the perch. The undersurface 24*c* of each cap abuts an end face 22*a* of the cover tube. Each cap shaft is secured to a recess 20*a*** at the tips of the core rod by any suitable means such as a screw thread connection. Alternatively, each cap may have an axial recess in its undersurface to receive a stud projecting from the rod end face, with the cap and stud joined and secured by press fit or adhesive.

The covering tube may be colored as appropriate to enhance the appearance of the ensemble of support and balancing sculpture.

Figure 3:
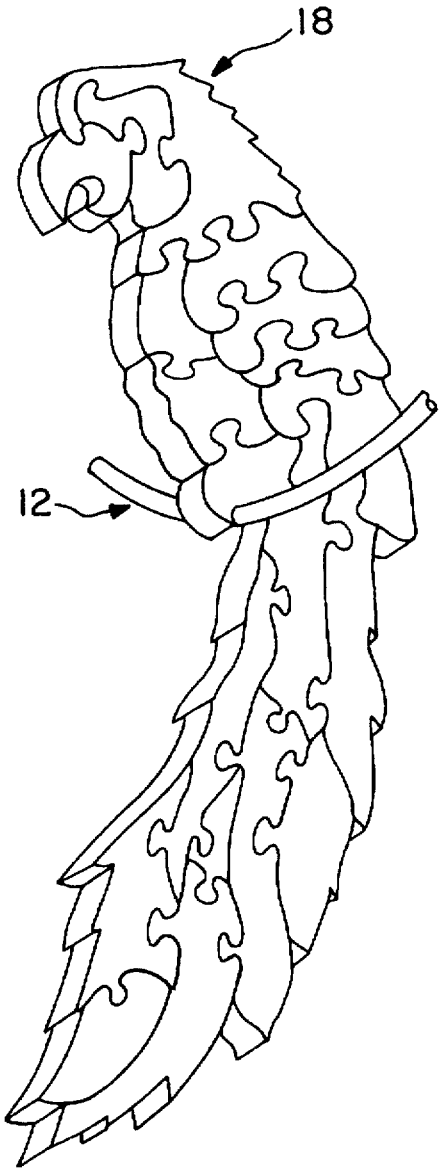
FIG. 3 is a perspective view of a support according to the invention mounting a balancing sculpture.
Figure 4:
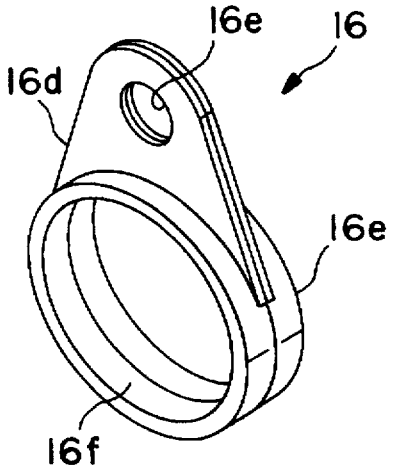
FIG. 4 is a perspective view of a hanger for the support of FIGS. 1–3.

The balancing sculpture 18 is positioned at the lower reach **12*b* of the perch as shown in FIGS. 2 and 3** for both the first and second hanger positions.

Various changes may be made to the structure embodying the principles of the invention. The foregoing embodiments are set forth in an illustrative and not in a limiting sense. The scope of the invention is defined by the claims appended hereto.

We claim:

1. A support for a balancing sculpture comprising an arcuate perch having a lower reach for receiving and displaying a balancing sculpture, a hanger mounted on the perch for movement between a first position wherein the support is suspended from a ceiling by means of a line connected to the hanger, and a second position wherein the support is adapted to be mounted on a wall by means of the hanger engaging a wall hook, so that the perch is maintained in the second position by the wall hook and by contact between the perch and the wall.

2. A support for a balancing sculpture comprising a perch member defining an arc of a circle having a lower reach for receiving and displaying a balancing sculpture, a hanger slidably mounted on the perch for movement between a first position wherein the support is suspended from a ceiling by means of a line engaging the hanger, and a second position wherein the support is mounted on a wall by means of a wall hook engaging the hanger so that the perch is maintained in the second position by the wall hook and by contact between the perch and the wall, the hanger being a plate with a top aperture for receiving said line, and a lower aperture for fitting onto the perch in sliding relation thereto.

3. A support for a balancing sculpture comprising a perch defining an arc of a circle greater than 180 degrees having a lower reach for receiving and displaying a balancing sculpture, the perch being formed of a tubular member, a hanger having an aperture and a hub, the hanger mounted on the perch by the hub for movement between a first position from which a line suspended from a ceiling is connected to the aperture, and a second position in which the aperture of the hanger mounts the support on a wall hook, so that the perch is maintained in the second position by the wall hook and by contact between the perch and the wall below the wall hook.

4. The combination of a support and a balancing sculpture, the support comprising an arcuate perch having an upper portion and a lower portion, a hanger mounted on the upper portion for movement between a first position wherein the support is suspended from a ceiling by means of a line engaging the hanger, and a second position wherein the support is mounted on a wall by means of a wall fitting engaging the hanger, so that the perch is maintained in the second position by the wall fitting and by contact between the perch and the wall and the balancing sculpture mounted on the lower portion of the perch.

5. A support for a balancing sculpture comprising a perch, the perch being an arc of a circle terminating in tips, the perch including an assembly of a crescent shaped core rod covered by a tube member, end caps connected to the core rod at each tip, and means fitted onto the tube for selectively connecting the support to a ceiling or to a wall.

6. A support as defined in claim 5 in which the tube member is foam rubber.

* * * * *